United States Patent [19]

Gies

[11] Patent Number: 4,460,207

[45] Date of Patent: Jul. 17, 1984

[54] DEVICE FOR THE CARRYING OF SKIS

[76] Inventor: Jakob Gies, Solmser Strasse 14, Niederaula/Mengshauser D 6434, Fed. Rep. of Germany

[21] Appl. No.: 314,372

[22] Filed: Oct. 23, 1981

[30] Foreign Application Priority Data

Nov. 6, 1980 [DE] Fed. Rep. of Germany ..... 3041895

[51] Int. Cl.[3] ..... A45C 71/00

[52] U.S. Cl. ..... 294/147; 224/917

[58] Field of Search ..... 294/147, 143, 146, 151, 294/153, 162, 164, 167; 211/605 T; 224/197, 200, 218, 250, 251, 270, 272, 917; 280/814, 815

[56] References Cited

U.S. PATENT DOCUMENTS

| | | | |
|---|---|---|---|
| 3,892,343 | 7/1975 | Warner | 294/147 |
| 3,985,275 | 10/1976 | Allen | 294/147 |
| 3,990,655 | 11/1976 | Covell | 294/147 |
| 4,040,551 | 8/1977 | Brumbaugh | 294/147 |
| 4,059,209 | 11/1977 | Grisel | 294/147 |
| 4,274,571 | 6/1981 | Lafreniere et al. | 294/147 |

FOREIGN PATENT DOCUMENTS

| | | | |
|---|---|---|---|
| 3834 | 5/1979 | European Pat. Off. | 294/147 |
| 54521 | 11/1933 | Norway | 294/147 |
| WO80/01761 | 9/1980 | PCT Int'l Appl. | 280/814 |

*Primary Examiner*—James B. Marbert

*Attorney, Agent, or Firm*—Roberts, Spiecens & Cohen

[57] ABSTRACT

A device for carrying skis comprising a T-shaped frame member including a vertical element and a horizontal element. The horizontal element is composed first and second intermediate members each having one end pivotably connected to the vertical element at one end thereof. A pair of pressing flaps are respectively pivotably connected to the intermediate members at the ends thereof remote from the ends which are connected to the vertical element. The pressing flaps are pivotably movable between an extended horizontal position and two vertical collapsed or storage positions. In one vertical position, the intermediate members extend horizontally and in the second more compact collapsed position, the intermediate members extend substantially vertical in adjoining relation to the vertical element. A shackle is provided for engaging the flaps when they are in an orientation parallel to the vertical element.

9 Claims, 7 Drawing Figures

DEVICE FOR THE CARRYING OF SKIS

BACKGROUND OF THE INVENTION

The present invention relates to a device for the carrying of skis, consisting of a T-shaped frame member on the horizontal piece of which there are pivoted swingable pressing flaps which can be connected together in an erect position by a shackle.

In one known device for the carrying of skis, the horizontal piece is firmly attached to the vertical piece of the T-shaped frame member so that the entire carrying device constitutes a relatively bulky structure even in the upward-swung condition of the pressing flaps.

BRIEF SUMMARY OF THE INVENTION

An object of the present invention is to provide a device for the carrying of skis in such a manner that the device can be folded together to form a less bulky unit.

This result is achieved, in accordance with the present invention, in the manner that the horizontal member is formed of two intermediate pieces which are pivoted to the vertical member and whose hinge pins are arranged close to or directly on the vertical member, the intermediate members carrying the pivoted pressing flaps. The vertical member has horizontally extending bearing supports by which the intermediate members are held in a horizontal position.

Furthermore, in accordance with one particularly advantageous embodiment, each hinge pin for the pressing flap is supported by projections or abutments from each intermediate member, the projections having a vertical supporting surface which forms a stop for the pressing flap in the horizontal position.

In this way, after removal of the skis from the device, the pivoted intermediate member can also be swung up so that the entire device is of relatively small thickness and can thereby easily be arranged in a bag such as generally carried by skiers.

This special mounting, on the one hand, of the pivoted intermediate member and, on the other hand, of the pressing flap pivoted to the intermediate member provides assurance that, in the unfolded condition of the device, the pressing flap will always assume an approximately horizontal position without the user having to take any special measures in order to assure such a result.

Furthermore, the shackle is pivotally secured to the pressing flap. In detail, the shackle is pivotally connected to a T-shaped fastening tab which is passed through a corresponding opening in the pressing flap. Thus, the shackle can be swung down along the inner side of the pressing flap when the device is to be folded together for storage.

DESCRIPTION OF THE DRAWINGS

Other objects, the features and advantages of the invention will be apparent from the following detailed description when read with the accompanying drawing which shows the present preferred embodiment of the invention.

In the drawing.

DETAILED DESCRIPTION

The ski-carrying device includes a T-shaped frame, designated generally as 1, which consists of the horizontal member 3 and the vertical member 2. Extending upward from member 2 is a carrying handle 4. The horizontal member 3 is formed of two intermediate members **3*a*, 3*b* which are pivoted at 5 and 6 respectively to the vertical member 2 about the hinge pins 5*b*,6*b* which are arranged close to or directly on the vertical member 2**.

The pivoted intermediate members **3*a* and 3*b* carry the pressing flaps 5*a* and 6**respectively pivoted thereon.

The vertical member 2 has at its lower end horizontally extending bearing supports 7 and 8 on which the intermediate members **3*a*, 3*b*** respectively rest when they assume the horizontal position. In this way the intermediate members can effect a swinging movement into the horizontal position.

Figure 4:
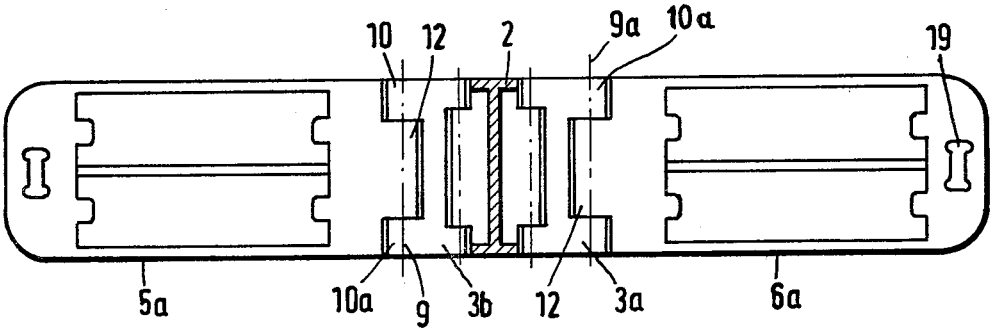
FIG. 4 is a top view of the device unfolded.

The hinge pins 9 and **9*a* for the pressing flaps 5*a*, 6*a* respectively are mounted in projections 10 and 10*a* of the intermediate members 3*a* and 3*b* respectively (FIG. 4). The projections have a vertical supporting surface 11 so that when the pressing flaps 5*a* and 5*b* are swung down into the horizontal position the pressing flaps find support on these supporting surfaces. In this way, the result is obtained that, upon the unfolding of the device, the pressing flaps automatically assume a horizontal position, in the same way as the intermediate members 3*a* and 3*b***, so that no special measures are necessary in order to hold the pressing flaps in the horizontal position.

The hinge pins 9, **9*a* are, in this connection, passed through a sleeve 12 which is arranged in the pressing flap. Thus, the pivot pins 9 and 9*a* extend on the one side through the projections 10 and 10*a* of the intermediate members 3*a* and 3*b* respectively and on the other side through the sleeve 12 of the pressing flaps 5*a* and 6*a*** respectively.

Figure 5:
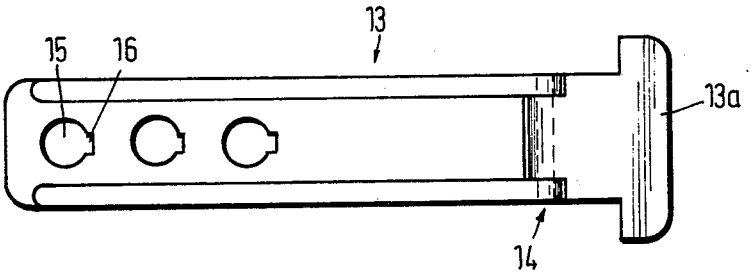
FIGS. 5 and 6 show the shackle for the holding of the pressing flaps together.
Figure 6:
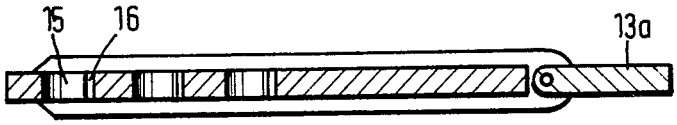
Figure 7:
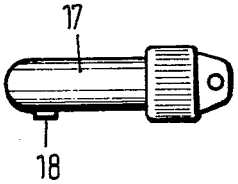
FIG. 7 shows the locking pin for the shackle.

The shackle 13 for connecting the pressing flaps together is pivoted to the pressing flap. For this, there is used a T-shaped fastening tab **13*a*, as can be noted in detail from FIGS. 5 and 6. The fastening tab 13*a* of the shackle 13 is pivotally connected at 14 to the shackle 13 which has holes 15 with a respective widened portion 16. A lock pin 17 having a locking nose 18 (FIG. 7) is placed through a hole 15**.

The T-shaped fastening tab **13*a* of the shackle is contained within a corresponding cutout 19 in the pressing flap 5*a* or 6*a***. The T-shaped development of the fastening tab prevents the shackle from being pulled out in a given direction. On the other hand, due to the pivoted arrangement of the yoke on the fastening tab, assurance is had that in order to collapse the entire device the shackle can be suitably swung away so that it can assume the space-saving position necessary for the collapsing operation.

Figure 1:
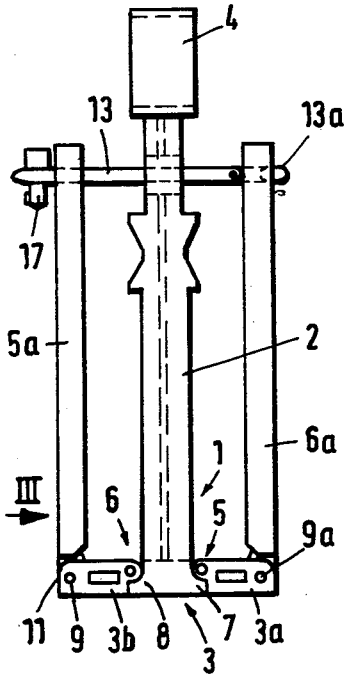
FIG. 1 is a side view of a ski carrying device in accordance with the invention.
Figure 2:
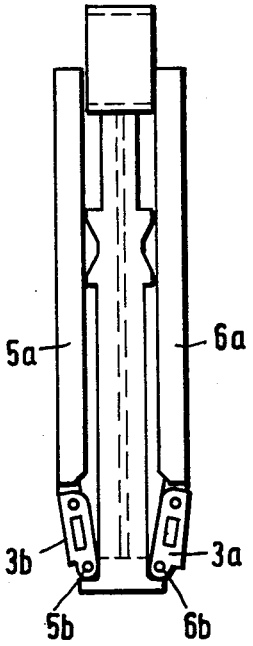
FIG. 2 is also a side view of the device but with the intermediate pieces swung up.
Figure 3:
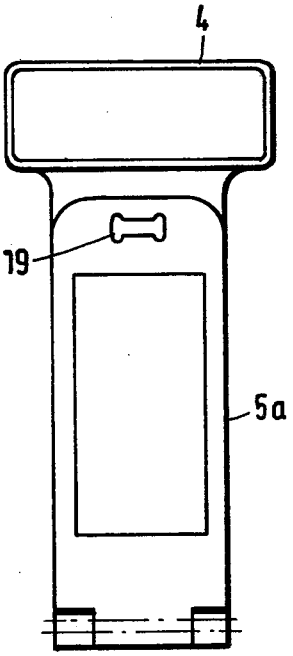
FIG. 3 is a view in the direction indicated by the arrow III in FIG. 1.

FIG. 2 shows the device with the intermediate member **3*a*, 3*b*** swung into upward position.

While only one embodiment of the device has been shown and described in detail, there will now be obvious to those skilled in the art many variations and modifications satisfying many or all of the objects of the invention without departing from the spirit thereof as defined by the appended claims.

What is claimed is:

1. A device for carrying skis comprising: a T-shaped frame member including a vertical element and a horizontal element, said horizontal element including first and second intermediate members, each having one end pivotably connected to one end of the vertical element and a second end, first and second pressing flaps pivotably connected to the second ends of said intermediate members, and shackle means for engaging said pressing flaps when they are in an orientation parallel to said vertical element, said intermediate members being pivotable on said vertical element between a first extended position substantially perpendicular to said vertical element in horizontal disposition and a second folded position in which said intermediate elements are adjacent said vertical element and extend substantially vertically.

2. The device of claim 1 wherein the end of said vertical element which pivotably supports said intermediate member abutments for supporting said intermediate members perpendicular to said vertical element.

3. The device of claim 1 or 2 wherein the second ends of said intermediate members include abutments for supporting the respective pressing flaps in planes parallel to the planes of the respective intermediate members.

4. The device according to claim 1 wherein said shackle means is pivotably mounted on said pressing flaps.

5. The device according to claim 4 wherein said pressing flaps are provided with openings near their ends remote from the pivotable connections and said shackle means includes a T-shaped tab pivotably connected at one end thereof whereby said shackle means can pass through said openings to engage said pressing flaps.

6. The device of claim 5 wherein the end of said shackle means remote from said T-shaped tab is provided with a hole, and a locking pin for passing through said hole.

7. The device of claim 6 wherein said hole is provided with a widened portion and said locking pin includes a nose for passing through the widened portion of said hole.

8. The device according to claim 1 wherein said pressing flaps are movable to a vertical upfolded position with the intermediate members disposed horizontally and to a collapsed position adjoining said vertical element with said intermediate members in said second folded position.

9. The device according to claim 1 wherein the pivot connections of said one end of the respective intermediate members to said vertical element are spaced horizontally on opposite sides of said vertical element.

* * * * *